US009834946B2

(12) United States Patent
Shukla

(10) Patent No.: US 9,834,946 B2
(45) Date of Patent: Dec. 5, 2017

(54) WORK SPACE ASSEMBLY FOR COLLABORATION AMONG TWO OR MORE SETS OF WORKERS

(71) Applicant: AUTOMATION ANYWHERE, INC., San Jose, CA (US)

(72) Inventor: Neeti Mehta Shukla, San Jose, CA (US)

(73) Assignee: AUTOMATION ANYWHERE, INC., San Jose, CA (US)

( * ) Notice: Subject to any disclaimer, the term of this patent is extended or adjusted under 35 U.S.C. 154(b) by 0 days.

(21) Appl. No.: 14/927,820

(22) Filed: Oct. 30, 2015

(65) Prior Publication Data

US 2017/0121969 A1 May 4, 2017

(51) Int. Cl.
*E04B 1/346* (2006.01)
*E04H 1/06* (2006.01)
*E04B 2/74* (2006.01)

(52) U.S. Cl.
CPC ..... *E04H 1/06* (2013.01); *E04B 2/7401* (2013.01)

(58) Field of Classification Search
CPC ..... E04B 2/74; E04H 1/06
USPC ..... 52/65; 297/172, 174 R, 240
See application file for complete search history.

(56) References Cited

U.S. PATENT DOCUMENTS 3,233,346 A * 2/1966 Cornberg ..... E04H 1/12 379/453
3,818,609 A * 6/1974 Woolman ..... G09B 7/04 434/237
4,625,633 A * 12/1986 Martin ..... A47B 83/001 454/230
5,016,405 A * 5/1991 Lee ..... A47B 83/001 108/60
5,065,832 A * 11/1991 Mark ..... A47B 21/06 108/50.02
5,282,341 A * 2/1994 Baloga ..... A47B 83/001 49/41
5,765,315 A * 6/1998 Nagamitsu ..... A47B 13/10 108/50.01
6,115,171 A * 9/2000 Minami ..... G02F 1/1533 359/237
6,148,568 A * 11/2000 Beasley ..... E04B 1/346 104/44
6,474,025 B1 * 11/2002 Faiks ..... A47B 21/00 52/239
6,851,748 B1 * 2/2005 Garrick ..... A47C 1/03 248/429
7,677,182 B2 * 3/2010 Mueller ..... A47B 21/00 108/50.01
8,505,245 B2 * 8/2013 Bobryshev ..... G09B 5/00 108/139
2004/0244307 A1 * 12/2004 Branc ..... G09F 15/0068 52/36.1

(Continued)

*Primary Examiner* — Brian Glessner
*Assistant Examiner* — Joshua Ihezie
(74) *Attorney, Agent, or Firm* — Joseph R. Carvalko, Jr; Cara C Morris

(57) ABSTRACT

This invention generally relates to a workspace based on a central-themed geometric configuration, wherein a circular area is divided into pie segments that relate a first team of working associations, separated radially, from a second team of working associations, first and second teams of associations collocated circumferentially into teams of differing and similar tasked members.

10 Claims, 3 Drawing Sheets

(56) References Cited

U.S. PATENT DOCUMENTS

| | | | | |
|---|---|---|---|---|
| 2005/0016081 | A1* | 1/2005 | Gomree | A47B 13/04 52/36.1 |
| 2012/0038587 | A1* | 2/2012 | Alford | B64D 11/06 345/174 |
| 2014/0038164 | A1* | 2/2014 | Battey | G09B 19/00 434/365 |
| 2014/0362027 | A1* | 12/2014 | Hsu | G06F 3/044 345/174 |

* cited by examiner

WORK SPACE ASSEMBLY FOR COLLABORATION AMONG TWO OR MORE SETS OF WORKERS

FIELD OF THE INVENTION

The present invention relates to a work space assembly for use during a collaboration among two or more sets of workers.

BACKGROUND OF THE INVENTION

Work space divider systems, which typically include partition systems that divide space into sub-spaces, are employed to assist collaborative activity, while also maintaining a level of privacy. In certain occupations, collaborative activity is essential for innovation. In many cases, especially large projects, such as programming projects that enlist dozens of individuals with varying assignments, which may include, design, coding, testing, quality control, marketing, sales and service, immediate face-to-face collaboration is difficult due to project members being physically separated. In most instances, teamwork requires one to walk distances or communicate over emails or text facilities, which are costly and inefficient. When groups of people need to interact, as between co-workers or supervisors, or other project team associates that involve disparate, but project related activities, there may be workspace arrangements vis-à-vis partitions, egress and ingress that can improve an individual's efficiencies, and creative contributions, and in some cases physical space arrangements act as a catalyst for the co-worker motivation and individual efficiencies.

Project managers are generally aware that there are times when they need privacy or personal space to perform certain employment and creative tasks. Other team members may desire privacy, or at times, degrees of privacy, to block out distractions. In other instances aside from the level of privacy a project manager or team may desire, he/she may also require a proximity to the individuals over whom they have supervisory responsibility and to their supervisory counterparts working on the other aspects of the same or similar projects. In this instance work spaces often must attempt to fulfill the multiple requirements of privacy, allowing workers to have their separate collaborative space, and yet offer proximity to one's immediate supervisor and others who may be more remotely related to a project.

What is needed is a workspace arrangement that optimizes a team member's focus on the assignments for which they are responsible, while allowing the member to interact with other team members and with members of other teams working on other aspects of the same or similar projects, while maximizing work flow and overall product development collaboration and efficiencies.

SUMMARY OF THE INVENTION

The invention relates to a workspace assembly for team collaboration wherein a circular area is divided into pie segments, wherein a first segment, containing a first enclosed workspace at a radial distance from an associated second workspace, is adjacent to a second segment containing a first enclosed workspace at a radial distance from an associated second workspace, each workspace collocated circumferentially, to a corresponding workspace.

In one embodiment of the invention, workspaces in a segment located radially outward from the center of the circle, are separated from other segments of collocated workspaces by angularly opposing separators.

In another embodiment the angularly opposing separators provide one or more functions of removability, levels of opacity or transparency between collocated workspaces, or electronic screens for communication.

In yet another embodiment of the invention a workspace assembly is collocated circumferentially to corresponding associated workspaces at associated concentric levels, wherein the levels rotate relative to other concentric levels, and additionally any workspace situated on a rotatable platform, rotates, so as to be reoriented with respect to an opposing workspace.

DESCRIPTION OF PREFERRED EMBODIMENT

The present invention is described with reference to the accompanying drawings, in which preferred embodiments of the invention are shown. This invention may be embodied in different forms and should not be construed as limited to the embodiments set forth. Rather, these embodiments are provided so that this disclosure will be thorough and complete, and will convey the scope of the invention to those skilled in the art. Like numbers refer to like elements throughout.

Figure 1:
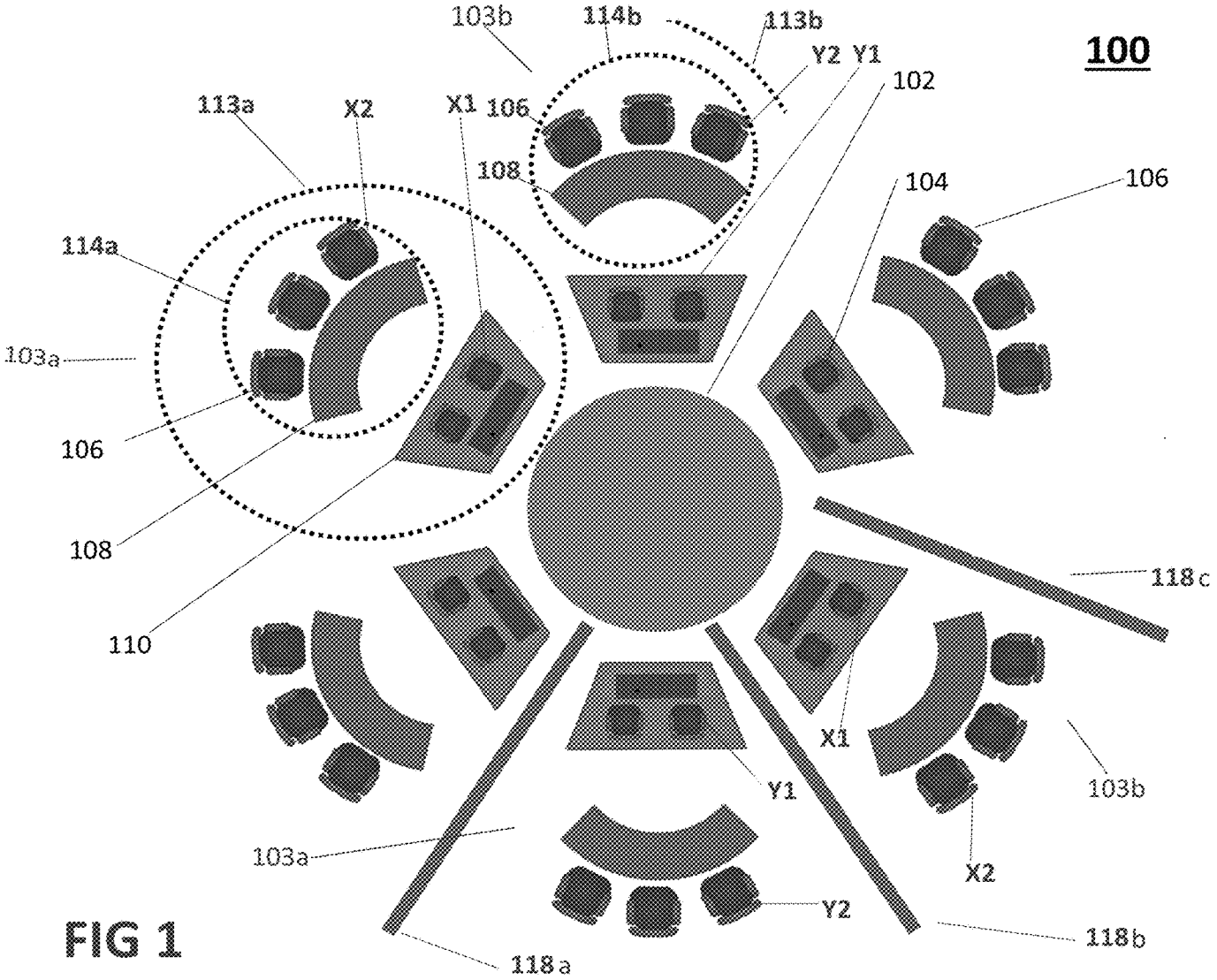
FIG. 1 shows a plan view of an assembly of an arrangement of workspace in accordance with an embodiment of the present invention.
Figure 2:
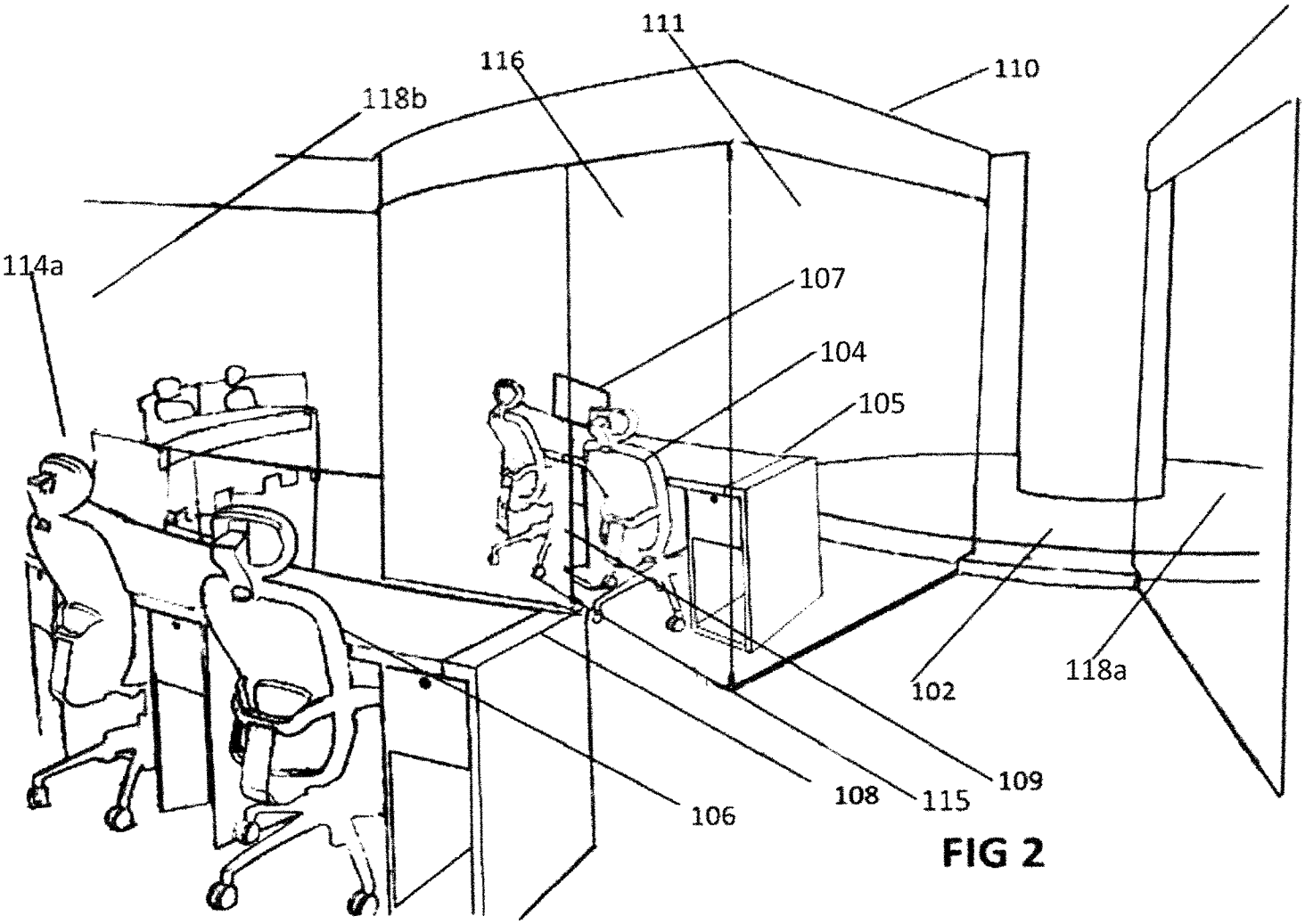
FIG. 2 shows a perspective view of an assembly of an arrangement of workspace in accordance with an embodiment of the present invention.
Figure 3:
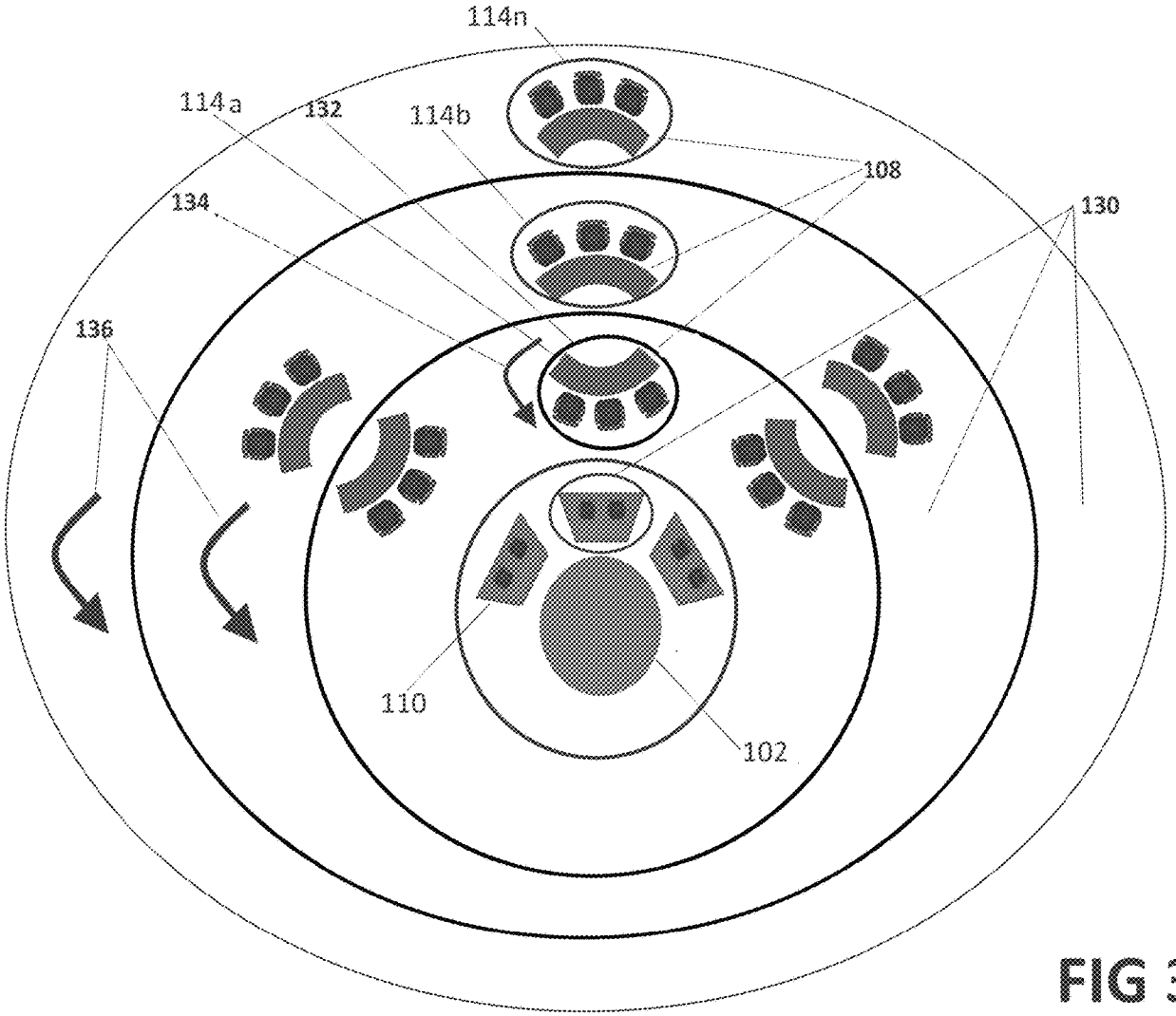
FIG. 3 shows a plan view of the moveable feature of a workspace in accordance with an embodiment of the present invention.

FIG. 1, FIG. 2 and FIG. 3 represents a workspace assembly for team collaboration comprising a first segment 103*a* containing a first enclosed workspace 110, at a radial distance from an associated second workspace 114*a*, said first segment adjacent to a second segment 103*b* containing a second enclosed workspace 110 at a radial distance from an associated third workspace, 114*b*, said enclosed workspaces collocated circumferentially to corresponding workspaces, and said associated workspaces collocated circumferentially to corresponding associated workspaces.

More particularly, FIG. 1 shows an assembly 100, which discloses a workspace for use during a collaboration among two or more sets of workers within an associated area 113*a*, containing workers such as, X1, located in workspace 110 and workers X2, located in workspace 114*a*. Each set of two or more workers, X1 and X2, are radially separated, from a central core 102. As shown in FIG. 1 and FIG. 3, within associated area 113*a*, one workspace 110 exists, however, any number of workspaces, such as 114*a* may exist, as the application requires, such that each additional workspaces such as references as 114*a*, 114*b*, and 114*n*, are located radially distant from workspace 110. Each workspace level that includes workers, such as X1, Y1 and X2, Y2, are collocated in outwardly radiating concentric circles around a center work area 102.

In the embodiment shown in FIG. 1, there are six segments, such as 103*a*, or sets of workspaces, surrounding the center of the work area 102. The two or more workers, X1, X2 within segment 113*a*, share a work association between themselves, and between the one or more workers of Y1, Y2 within segment 113*b*. There may be a multiplicity of associated areas, such as 113*a*, 113*b*. The segments 103 may be affiliated with different work tasks, such as salespersons in segment 113*a*, and product design personnel in segment 113*b*.

The individuals represented by the reference X1 may share a work association among other sets of workers on the same level, such as Y1. Individuals, such as X2 may share a work association among other sets of workers on the same level, such as Y2. In a non limiting application of the invention, X1 may be the supervisor of X2. In one non limiting example, Each of the two or more workers located at a first level, such as X1, Y1, utilize an enclosure 110 radially separate from the two or more workers X2, Y2 located in workspace 114*a*, 114*b*, respectively. In one non limiting embodiment, the enclosure 110 is in the shape of an isosceles trapezium. The enclosure typically has glass outer walls 111, and an entrance 116. The enclosure 110, includes at least one work surface 105, at least one chair 104, a controller 107, that allows the operation of the various separator 118*a*, 118*b*, functions as well as communicate with the workers in workspace 114*a*, 114*b*, etc.

The enclosure 110 is also adjacent to its respective workspace, e.g., workspace 114*a*, where each workspace 114*a*, also has at least one work surface 108, at least one chair 106, and a multifunctional partition 109 (FIG. 2).

Again referring to FIG. 1, each segment 113*a* may be separated from an adjacent segment 113*b* by angularly opposing separators, as by way of example, 118*a*, 118*b*, and 118*c*. In one embodiment some or all the separators are removed. The opposing separators 118*a*, 118*b*, and 118*c* may be constructed in whole or in part of a material such as glass or other optically transparent material or a material that reduces noise. Additionally the separators may optionally function in whole or part, as display screens, smart boards or white boards, allowing information to be communicated or collaboratively shared, between and among segments (e.g., 103*a*, 103*b*).

Turning to FIG. 2, the workspace assembly for team collaboration includes one or more separate circumferentially collocated workspaces utilizing angularly opposing walls, each workspace containing an enclosure 110 radially separating the workspace 114*a* having at least one work surface 108, and at least one chair 106, and a multifunctional separator 109 between the enclosure and the workspace.

One or more of the individuals located in workspace 110, may using the controller 107, electronically control a customizable work-related message or theme transmitted, projected or displayed on the separator 118*a* and/or separator 118*b* or the multifunctional partition 109. Such information may be in the form of work-related messages, projections or displays, for a variety of purposes, including one of project code names, motivational, inspirational messaging, stress reducing, team-building, alerts, work instructions, and other applications that a management deems necessary in a working environment. In other instances, a non-limiting embodiment of the invention the separators 118*a*, 118*b*, are made transparent to increase team collaboration, or opaque or partially opaque to reduce distraction, shield work product from third parties, or for general confidential or privacy purposes.

In one non-limiting embodiment of the invention one or more separators 118*a*, 118*b* may be controlled such that a color code scheme may be employed to features or elements of the separator 118*a*, 118*b* i.e., surface and/or edging, to designate group designation, or affinity or project work mode.

Referring to FIG. 1 and FIG. 2, by way of example, and not limitation, the color green may be displayed on all or part of a separator 118*a*, 118*b*, and 118*c*, between associated areas 113*a*, 113*b* that for example might be developing environmentally friendly packaging, or multiple colors may be displayed as described to show collaboration between working groups for example, between 113*a* and another working segment 113*b* responsible for example for market testing.

In one non-limiting embodiment of the invention one or more separators 118*a*, 118*b* are constructed in whole or part from smart glass or switchable glass in which features of the glass are altered by for example the application of voltage, light or heat to alter the glass from translucent to transparent, or changing from blocking some (or all) wavelengths of light to letting light pass through which may be accomplished through a variety of technologies such as electrochromic, photochromic, thermos-chromic, suspended particle, micro-blind and polymer dispersed liquid crystal technologies.

In FIG. 2, the multifunctional partition 109, may represent a display, smart board or white board, allowing information to be communicated or collaboratively shared, between individuals such as located in workspace 114*a*, and among the individuals in work space 110, or in other collocated segments, 113*b*.

Referring to FIG. 3, one non-limiting embodiment of the invention allows any one or more concentric levels 130, for example, to rotate 136, and thereby move relative to other concentric levels, thus shifting the associated arrangement of workspaces 114*a*, 114*b*, 114*n* and 110. Similarly, any workspaces 114*a*, 114*b*, 114*n* and 110 may be placed on a rotatable platform, to rotate 134, so as to be oriented 132 to face an opposing workspaces, such as 114*a* facing 114*b* or 110 facing 114*a*, 114*b*, 114*n*. Mechanisms for rotation are well known in the mechanical arts.

While the foregoing invention has been described with reference to the above embodiments, additional modifications and changes can be made without departing from the spirit of the invention.

I claim:

1. A workspace assembly collocated about a circular center for team collaboration comprising a first segment containing a first enclosed workspace having at least one separate work surface and one or more chairs, all said chairs facing the circular center, at a radial distance from one or more associated unenclosed workspaces, said first segment adjacent to a second segment containing a second enclosed workspace having at least one separate work surface and one or more chairs facing the circular center, at a radial distance from one or more associated workspaces, said enclosed workspaces and associated workspaces, collocated circumferentially to corresponding enclosed workspaces and associated workspaces, and separated by a separator constructed of a switchable glass alterable from transparent to one of partially opaque or opaque by application of one of a voltage, light or heat.

2. The workspace assembly of claim 1, wherein the enclosure is in the shape of an isosceles trapezium.

3. The workspace assembly of claim 1, includes a controller to control information to be communicated to the separator comprised of one of a white board or smart screen.

4. The workspace assembly of claim 3, wherein a customizable work-related message included in the information to be communicated is one or more of motivational messages, stress reducing messages, team-building messages, work related information.

5. The workspace assembly of claim 1, wherein one or more separators are opaque to achieve one of reducing distraction, shielding work, or having other confidential or privacy purposes.

6. A workspace assembly for team collaboration comprising a circular configuration, wherein a circular area divided into pie segments relates a first team enclosed workspace having at least one separate work surface and one or more chairs, all the chairs facing a center work area of a circle, separated radially from a second team unenclosed workspace having at least one separate work surface and one or more chairs, all the chairs facing a center work area of a circle, said first and second team workspace divided by angularly opposing smart glass separators, from one or more workspaces, collocated circumferentially around the circular area, each workspace having at least one separate work surface and one or more chairs, all the chairs facing a center work area of a circle.

7. The workspace assembly of claim 6, wherein each separator is a smart board, white board, or smart glass, said separator features alterable by the application of one or more of: voltage, light or heat to alter the separator from one of opaque, partially opaque, translucent, or transparent.

8. The workspace assembly of claim 6, wherein each separator is a smart board, white board, or smart glass, said separator features alterable by blocking wavelengths of light, thus enabling light to pass through, utilizing one or more of: electrochromic, photochromic, thermos-chromic, suspended particle, micro-blind and polymer dispersed liquid crystal technologies.

9. A workspace assembly for team collaboration comprising a first segment containing a first enclosed workspace having at least one separate work surface and one or more chairs, all the chairs facing a center work area of a circle, at a radial distance from an associated unenclosed rotatable second workspace having at least one separate work surface and one or more chairs, all the chairs facing a center work area of a circle, said first segment adjacent to a second segment containing a second enclosed workspace having at least one separate work surface and one or more chairs, all the chairs facing a center work area of a circle, at a radial distance from an associated rotatable third workspace having at least one separate work surface and one or more chairs, all the chairs facing a center work area of a circle, said enclosed workspaces collocated circumferentially to corresponding associated workspaces, and separated by a smart glass separator between the enclosed workspaces and associated workspaces.

10. The workspace assembly of claim 9, further including associated workspaces collocated circumferentially to corresponding associated workspaces at associated concentric levels, wherein the levels rotate relative to other associated concentric levels.

* * * * *